US007559363B2

(12) United States Patent
Howell et al.

(10) Patent No.: US 7,559,363 B2
(45) Date of Patent: Jul. 14, 2009

(54) WIPER DARTS FOR SUBTERRANEAN OPERATIONS

(75) Inventors: Matt Howell, Duncan, OK (US); Ronald L. Hinkie, Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 86 days.

(21) Appl. No.: 11/620,455

(22) Filed: Jan. 5, 2007

(65) Prior Publication Data

US 2008/0164031 A1 Jul. 10, 2008

(51) Int. Cl.
*E21B 23/10* (2006.01)
*E21B 43/25* (2006.01)

(52) U.S. Cl. ..... 166/153; 166/156; 166/305.1

(58) Field of Classification Search ..... 166/153, 166/156, 305.1, 155, 177.4, 291
See application file for complete search history.

(56) References Cited

U.S. PATENT DOCUMENTS

| | | | | | |
|---|---|---|---|---|---|
| 1,122,246 | A | * | 12/1914 | Beam | 92/87 |
| 2,164,195 | A | | 6/1939 | Waltermire | 137/77 |
| 2,627,314 | A | | 2/1953 | Baker et al. | 166/1 |
| 2,856,002 | A | | 10/1958 | True et al. | 166/114 |
| 2,913,054 | A | | 11/1959 | Falk | 166/224 |
| 3,050,121 | A | | 8/1962 | Garrett et al. | 166/46 |
| 3,065,794 | A | | 11/1962 | Page | 166/125 |
| 3,091,294 | A | | 5/1963 | Evans et al. | 166/193 |
| 3,111,988 | A | | 11/1963 | Davis et al. | 166/42 |
| 3,159,219 | A | | 12/1964 | Scott | |
| 3,289,762 | A | | 12/1966 | Schell et al. | 166/35 |
| 3,314,479 | A | | 4/1967 | McCullough et al. | 166/63 |
| 3,545,542 | A | * | 12/1970 | Scott | 166/155 |
| 3,653,435 | A | | 4/1972 | Reistle et al. | 166/366 |
| 3,667,544 | A | * | 6/1972 | Allimon | 166/170 |
| 3,789,926 | A | | 2/1974 | Henley et al. | |
| 4,044,827 | A | | 8/1977 | Kerzee et al. | 166/133 |
| 4,069,535 | A | | 1/1978 | Cato | 15/104.061 |

(Continued)

FOREIGN PATENT DOCUMENTS

| | | |
|---|---|---|
| EP | 0697496 | 2/1996 |

(Continued)

OTHER PUBLICATIONS

Foreign communication related to a counterpart application dated Apr. 4, 2008.

(Continued)

*Primary Examiner*—Giovanna C Wright
(74) *Attorney, Agent, or Firm*—John W. Wustenberg; Baker Botts, LLP.

(57) ABSTRACT

Methods and devices useful in subterranean treatment operations are provided. One example of a device is a dart having a deformable body, a nosepiece connected to a lower terminus of the deformable body, and a channel extending through the deformable body and the nosepiece. One example of a method includes providing a dart, providing a production casing having at least one production sleeve therein, placing the dart in the production casing of a well bore, pumping a treatment fluid into the well bore, and allowing the dart to open the production sleeve within the production casing such that the treatment fluid is introduced into the subterranean formation through the production casing.

19 Claims, 7 Drawing Sheets

U.S. PATENT DOCUMENTS

| | | | | |
|---|---|---|---|---|
| 4,083,076 | A | 4/1978 | Girard | 15/140.061 |
| 4,164,980 | A * | 8/1979 | Duke | 166/291 |
| 4,345,402 | A | 8/1982 | Hanson et al. | 446/430 |
| 4,378,838 | A | 4/1983 | Ogden et al. | 166/153 |
| 4,499,951 | A | 2/1985 | Vann | 166/297 |
| 4,509,222 | A | 4/1985 | Knapp | 15/104.061 |
| 4,545,434 | A | 10/1985 | Higgins | 166/217 |
| 4,836,279 | A | 6/1989 | Freeman | 166/153 |
| 5,012,867 | A * | 5/1991 | Kilgore | 166/188 |
| 5,036,922 | A | 8/1991 | Braddick | 166/383 |
| 5,234,052 | A | 8/1993 | Coone et al. | 166/155 |
| 5,311,940 | A | 5/1994 | LaFleur | 166/152 |
| 5,398,763 | A | 3/1995 | Watson et al. | 166/382 |
| 5,432,270 | A | 7/1995 | Zasloff et al. | 536/23.5 |
| 5,433,270 | A | 7/1995 | LaFleur | 166/152 |
| 5,435,386 | A | 7/1995 | LaFleur | 166/156 |
| 5,787,979 | A * | 8/1998 | Giroux et al. | 166/177.4 |
| 5,829,523 | A | 11/1998 | North | 166/250.14 |
| 5,928,049 | A | 7/1999 | Hudson | 446/4 |
| 5,979,557 | A | 11/1999 | Card et al. | 166/300 |
| 5,984,014 | A | 11/1999 | Poullard et al. | |
| 6,196,311 | B1 | 3/2001 | Treece | 166/192 |
| 6,666,275 | B2 | 12/2003 | Neal et al. | |
| 6,725,917 | B2 | 4/2004 | Metcalfe | 166/153 |
| 6,880,636 | B2 | 4/2005 | Rogers et al. | 166/290 |
| 6,951,246 | B2 | 10/2005 | Tessier et al. | 166/153 |
| 6,973,966 | B2 * | 12/2005 | Szarka | 166/153 |
| 7,048,066 | B2 | 5/2006 | Ringgenberg et al. | |
| 2002/0100590 | A1 | 8/2002 | De Almeida | 166/339 |
| 2005/0103493 | A1 | 5/2005 | Stevens et al. | 166/265 |
| 2005/0103504 | A1 | 5/2005 | Szarka | |
| 2005/0241824 | A1 | 11/2005 | Burris, II et al. | |
| 2007/0095527 | A1 | 5/2007 | Szarka | 166/156 |
| 2007/0095538 | A1 | 5/2007 | Szarka et al. | 166/308.1 |
| 2008/0135248 | A1 | 6/2008 | Talley et al. | |
| 2008/0149336 | A1 | 6/2008 | Szarka et al. | |

FOREIGN PATENT DOCUMENTS

| | | |
|---|---|---|
| EP | 0919693 | 6/1999 |
| EP | 1126131 A1 | 8/2001 |
| EP | 1 340 882 | 9/2006 |
| GB | 2 396 173 | 6/2004 |
| SU | 1439264 | 11/1988 |
| SU | 1548469 | 3/1990 |
| WO | WO 02/25056 | 3/2002 |
| WO | WO2005052312 | 6/2005 |
| WO | WO2005052316 | 6/2005 |
| WO | WO2007051969 | 5/2007 |
| WO | WO2007051970 | 5/2007 |
| WO | WO2008/071912 | 6/2008 |
| WO | WO2008/081168 | 7/2008 |

OTHER PUBLICATIONS

Foreign communication, May 2, 2007.
Foreign communication, Feb. 12, 2007.
Brochure Entitled "Landing Nipples and Lock Mandrels," from Otis Engineering Corp., General Sales Catalog.
Halliburton Casing Sales manual, Section 4.14, "SSR Plug Releasing Darts.".
Foreign Communication from a Related Counterpart Application, Feb. 2, 2005.
Foreign Communication from a Related Counterpart Application, Apr. 13, 2006.
Foreign Communication from a Related Counterpart Application, Feb. 14, 2007.
Office Action from U.S. Appl. No. 11/263,729, filed Oct. 24, 2007.
Office Action from U.S. Appl. No. 11/263,729, filed May 18, 2007.
Office Action from U.S. Appl. No. 10/714,832—Notice of Allowance, Oct. 12, 2005.
Office Action from U.S. Appl. No. 10/714,832, filed May 19, 2005.
Final Office Action from U.S. Appl. No. 10/714,831, filed Jun. 5, 2006.
Office Action from U.S. Appl. No. 10/714,831, filed Dec. 30, 2005.
Final Office Action from U.S. Appl. No. 11/263,730, filed Oct. 22, 2007.
Office Action from U.S. Appl. No. 11/263,730, filed May 18, 2007.
U.S. Appl. No. 11/615,180, filed Jan. 6, 2007.
Notice of Allowance from U.S. Appl. No. 11/263,730, filed Jan. 23, 2008.
Office Action from U.S. Appl. No. 11/263,729, filed Feb. 13, 2008.
Office Action from U.S. Appl. No. 11/263,729, filed Apr. 25, 2008.
Office Action from U.S. Appl. No. 11/263,729, filed Jun. 16, 2008.
Office Action from U.S. Appl. No. 11/615,180, filed Jun. 25, 2008.

* cited by examiner

WIPER DARTS FOR SUBTERRANEAN OPERATIONS

BACKGROUND

The present disclosure generally relates to subterranean operations. More particularly, the present disclosure relates to wiper darts in multi-zone subterranean treatment operations and associated methods of use.

Typically, during the stimulation of subterranean wells, a production sliding sleeve having ports is introduced into the well bore for fracturing, acidizing, or other treatment applications. A number of sleeves may be run on a single production string. The sleeve(s) may be operated by either a mechanical or hydraulic shifting tool run on coiled tubing or on jointed tubing using a ball-drop system. In the ball-drop system, a ball is dropped into the well bore and then fluid pumped into a portion of the sleeve at a sufficient pressure such that the ball lands on a baffle. Additional pressure causes the sleeve to open. Once the sleeve is opened, the ports of the sleeve align with ports in the production string and fluid flow is diverted through the ports. One concern with this process is that the time it takes for the ball to travel into a horizontal portion of the well and open a given sleeve may be difficult to determine since the ball does not necessarily stay at the leading edge of the fluid, and fluid may bypass the ball prior to the ball landing on the baffle.

Conventional balls used in the ball-drop system are solid and have varying diameters. Due to the solid nature of conventional balls, pressure and fluid flow are separated rather than displaced as there is space for pressure and fluid to bypass the solid ball, thus pressure and fluid can bypass the solid ball and place more fluid in the lower stimulated zone than optimal. This can overdisplace the stimulation fluid further inside the formation than is optimal. Conventional sleeves used in the ball-drop system are by their very nature difficult to drill out. The plastic round ball and the cast iron baffle both have a tendency to spin when they are being drilled, which increases the time spent to remove them. Conventional balls used in the ball-drop system are thus difficult to use and more costly to drill out due to the increased time spent drilling.

In addition, when balls are used and multiple zones are desired, multiple systems may be required, since only a limited number of balls may be used in a specific application. This is due to the inner diameter (ID) restrictions of the baffles, which are created by the way the ball must fit within the baffle.

SUMMARY

The present disclosure generally relates to subterranean operations. More particularly, the present disclosure relates to wiper darts in multi-zone subterranean treatment operations and associated methods of use.

An example of a dart of the present invention is a dart comprising: a deformable body; a nosepiece connected to a lower terminus of the deformable body; and a channel extending through the deformable body and the nosepiece; wherein the channel has a pressure sealing member therein.

An example of a method of the present invention is a method of treating a subterranean formation comprising: providing a dart comprising a deformable body, a nosepiece connected to a lower terminus of the deformable body, and a channel extending through the deformable body and the nosepiece, wherein the channel has a pressure sealing member therein; providing a production casing having at least one production sleeve therein; placing the dart in the production casing of a well bore; pumping a treatment fluid into the well bore; and allowing the dart to open the production sleeve within the production casing such that the treatment fluid is introduced into the subterranean formation through the production casing.

The features and advantages of the present disclosure will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

Figure 1A:
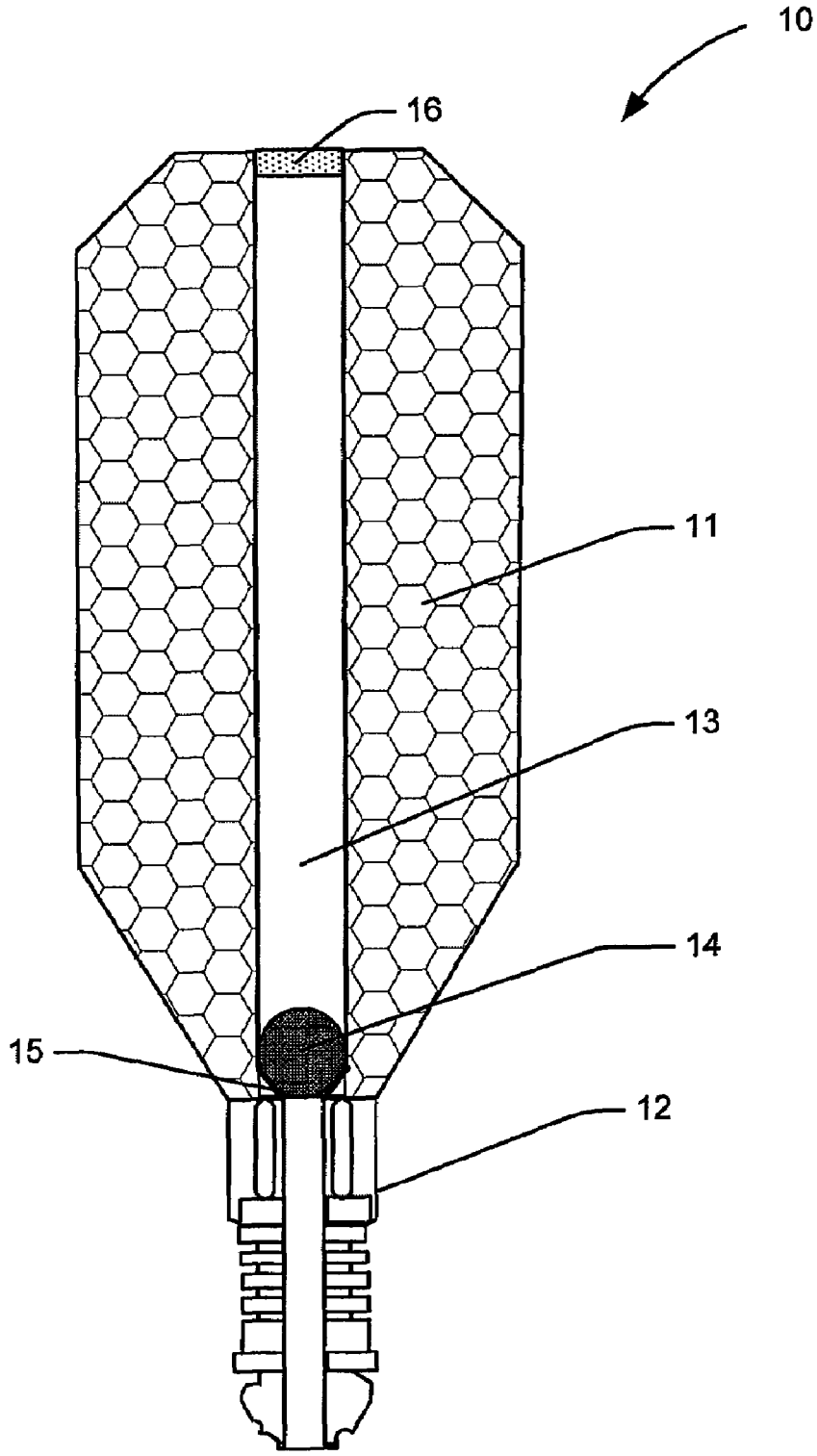
FIGS. 1A and 1B are side cross-sectional views of exemplary embodiments of a dart of the present invention.

While the present invention is susceptible to various modifications and alternative forms, specific exemplary embodiments thereof have been shown by way of example in the drawing and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF PREFERRED EMBODIMENTS

The present disclosure generally relates to subterranean operations. More particularly, the present disclosure relates to wiper darts in multi-zone subterranean treatment operations and associated methods of use. As used herein, the term "dart" may refer to any device that allows for positive displacement of fluid or pressure when used in a subterranean well bore. The term "dart" is not indicative of any particular shape.

The methods and devices of the present disclosure are advantageous over conventional methods and devices for a number of reasons. For example, one dart of the present disclosure may allow for positive displacement as the dart is pumped into a production casing. This would result in less over displacement of treatment fluid to a lower zone of a subterranean formation than is typically seen with conventional balls. Additionally, it may allow for a more accurate determination of when the dart will land in a landing profile, and thus when a sleeve within the production casing will be opened. Once the dart has landed in position, it may act as a flow-through plug, allowing higher pressure or flow from production below to come through the dart. The darts of the present disclosure may also be used in multi-zone operations both in conventional and tapered production strings. Furthermore, the darts of the present disclosure may be deformable, thus having the ability to wipe the largest diameter of a tapered casing string as well as the smaller diameters. Additionally, the darts of the present disclosure may be less expensive and more user friendly than plugs currently of use in the art.

To facilitate a better understanding of the present invention, the following examples of certain embodiments are given. In no way should the following examples be read to limit, or define, the scope of the invention.

Figure 1B:
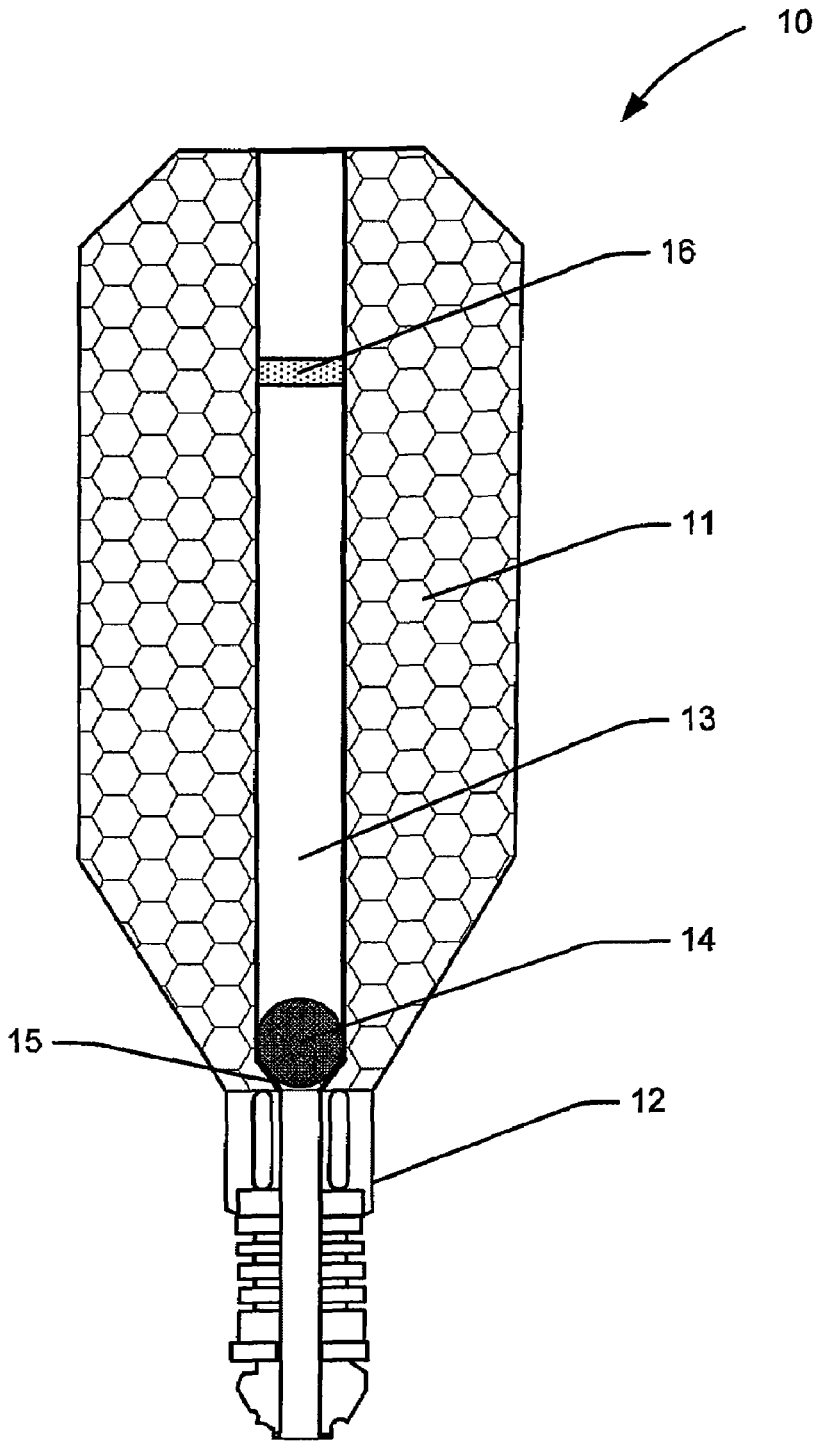

One exemplary embodiment of the device of the present invention is a dart 10, as depicted in FIG. 1A. Body 11 is connected to sealing or landing nosepiece 12 at a lower terminus of the body 11. Channel 13 runs through body 11 and nosepiece 12. Fluid is capable of flowing through channel 13. Enclosed within the portion of channel 13 in body 11 is ball 14. Ball 14 is capable of moving within the channel. When pressure is applied from above, ball 14 may rest upon ball seat 15, thus blocking fluid flow through channel 13. In some embodiments, channel 13 may be substantially hollow, and have a ball retainer 16 at an upper terminus of channel 13. Ball retainer 16 may be a cage, a screen, bars, or any other material which will prevent ball 14 from exiting channel 13. In one embodiment of the device of the present invention, the ball retainer 16 may be at a location other than a terminus of channel 13, as depicted in FIG. 1B.

Figure 4A:
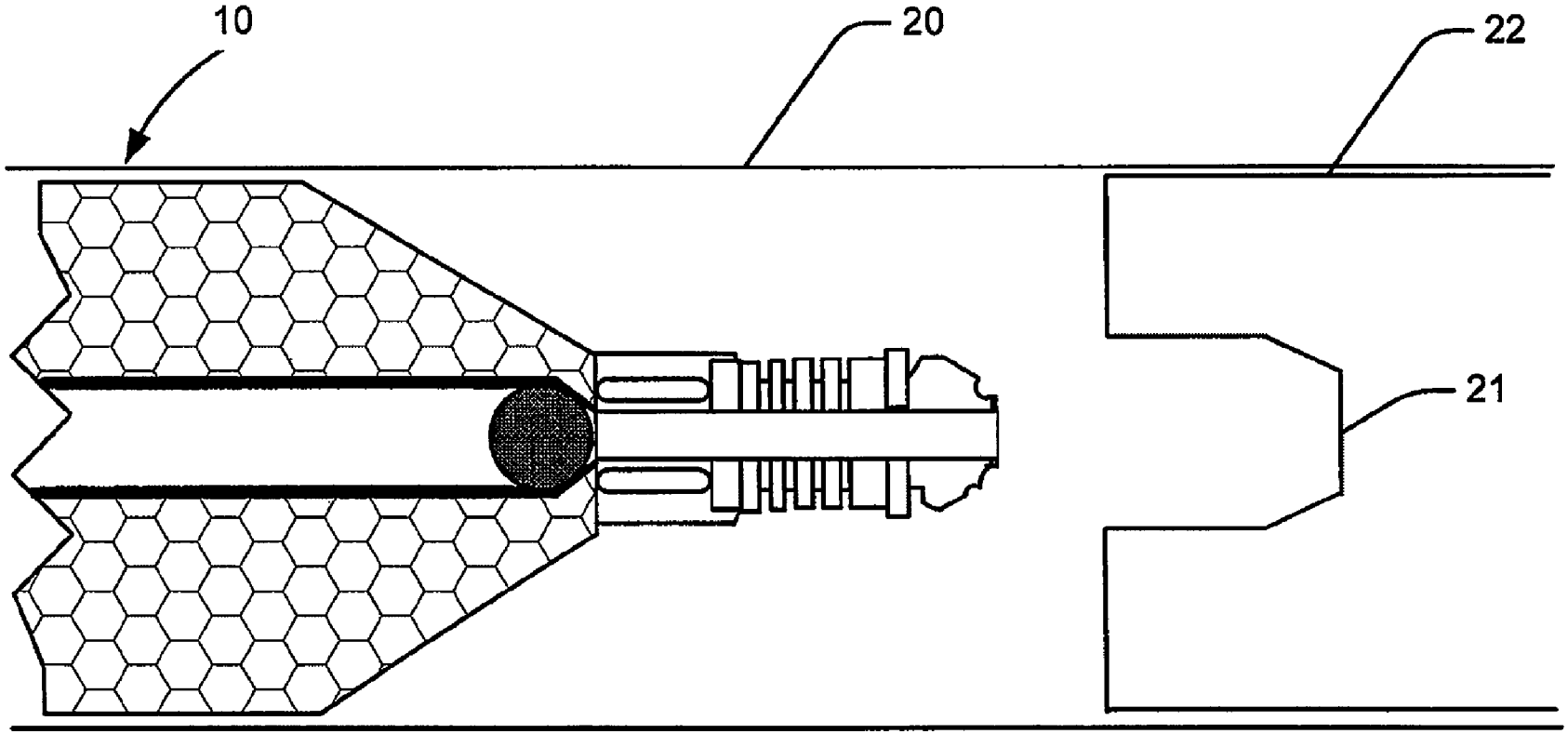
FIGS. 4A, 4B, and 4C illustrate an exemplary embodiment of a method of the present invention.

Body 11 may be constructed from any deformable material such as an elastomer including, but not limited to, open-cell foams selected from the group consisting of natural rubber, nitrile rubber, styrene butadiene rubber, polyurethane, and the like. In one embodiment, the body is formed of a compressible material, such as foam. Any open-cell foam having a sufficient density, firmness, and resilience may be suitable for the desired application. One of ordinary skill in the art with the benefit of this disclosure will be able to determine the appropriate construction material for body 11 given the compression and strength requirements of a given application. In certain exemplary embodiments of the present invention, body 11 comprises an open-cell, low-density foam. As depicted in FIG. 4A, body 11 generally should be sized to properly engage the inner wall of the largest diameter of production casing 20 through which the dart 10 will pass; in certain exemplary embodiments of the present invention, body 11 wipes clean the inner wall of production casing 20 as dart 10 travels the length of production casing 20, which length generally may extend the entire length of the well bore. Body 11 should also readily deform to pass through relatively small diameter restrictions without requiring excessive differential pressure to push the dart 10 to the desired location. For example, body 11 may deform such that the diameter of body 11 is equal to or smaller than the diameter of nose piece 12. Among other benefits, the dart 10 of the present invention may be used to wipe clean the inner wall of a production casing 20 having an inner diameter that varies along its length.

In certain exemplary embodiments of the present invention, body 11 has a substantially cylindrical shape with a tapered leading edge. In certain exemplary embodiments of the present invention, body 11 may have a constant cross-section. In certain other exemplary embodiments of the present invention, the outer surface of body 11 may comprise one or more ribs or fins which can be made of the same material as the invention or others. These ribs or fins may allow the dart to both wipe the inner diameter of the casing and be pumped down. Accordingly, in these and other embodiments body 11 may have a variable cross-section. Generally, in a natural state, the outside diameter of body 11 exceeds the outside diameter of nosepiece 13. In certain embodiments, the lower terminus of body 11 may conform to and sealingly engage nosepiece 12.

Nosepiece 12 may be manufactured from any material suitable for use in the subterranean environment in which the dart 10 will be placed. Examples of a suitable material include but are not limited to phenolics, composite materials, aluminum, and other drillable materials. In certain embodiments of the present invention, nosepiece 12 has an outer diameter that is smaller than the outer diameter of body 11. In certain embodiments, the leading end of nosepiece 12 may be have sealing rings, such as O-rings, which will provide a suitable seal between the nosepiece 12 and landing profile 21. As used herein, the term "landing profile" may refer to a portion of a production sleeve that is configured to engage a nosepiece of a dart of the present invention. A landing profile may be also characterized by one of skill in the art as a seat, baffle, or receiving configuration. One of ordinary skill in the art with the benefit of this disclosure will recognize the appropriate shape or configuration of nosepiece 12 relative to landing profile 21 of a production sleeve 22 (FIGS. 4A, 4B) that will be appropriate for a given application. In certain exemplary embodiments, a leading end of nosepiece 12 may be somewhat tapered, which will, among other benefits, facilitate the entry of the dart 10 into landing profile 21.

When multiple darts 10 are used in a single application, the size of nosepiece 12 and/or the body 11 may vary from dart to dart. This variance may be smaller than the variance required in the traditional ball-drop method. For example, the dart 10 with nosepiece 12 may only require about ⅛ inch difference from one landing profile to the next, as opposed to ¼ inches for the typical ball-drop system. This allows more production sleeves 22 to be utilized in a single well bore application. The interference required in the ball and baffle system is simple to keep the ball from deforming to the point that it can pass through the cast iron baffle with high pressure application. The sealing area on the wiper dart is in the o-rings in the nosepiece.

Figure 4B:
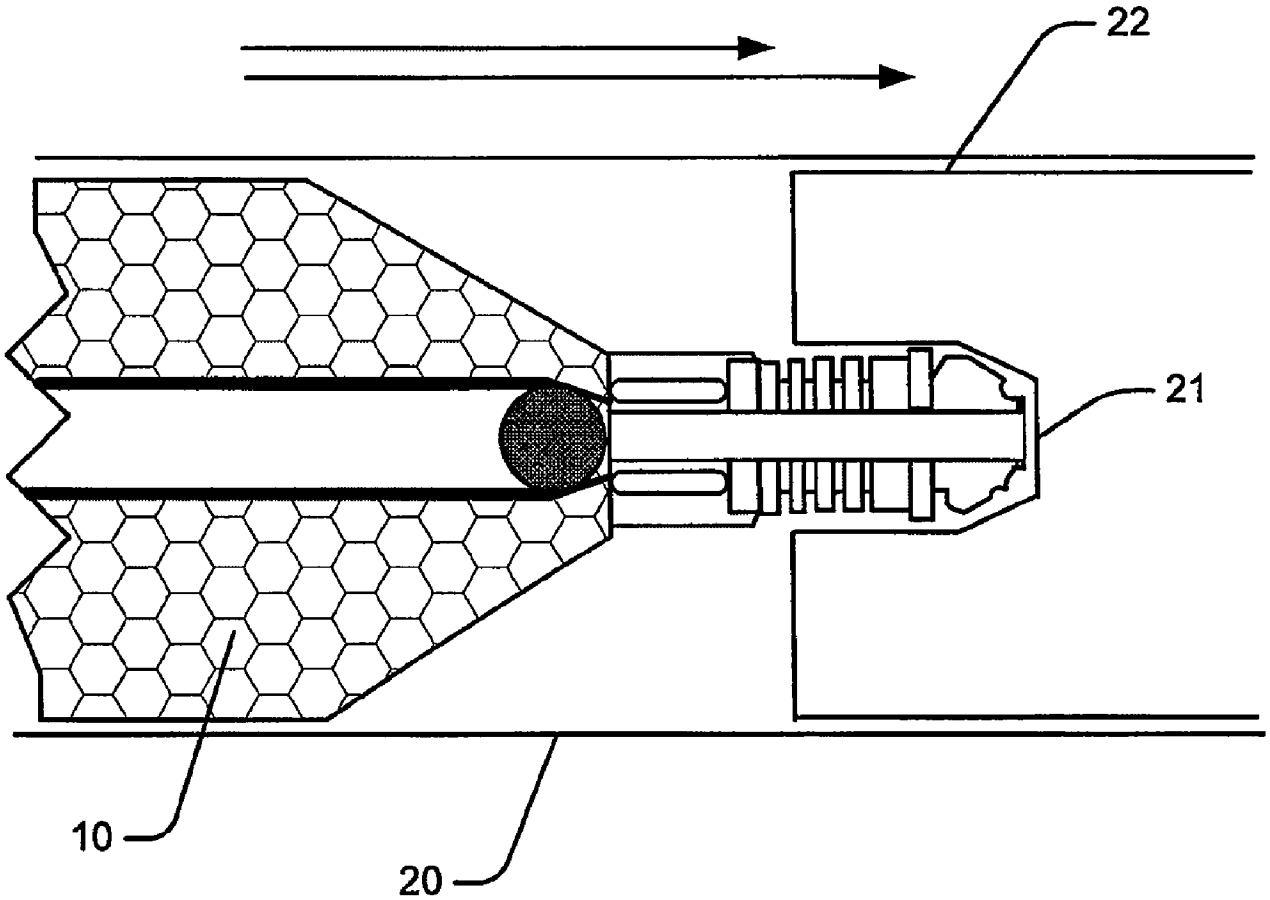

In certain embodiments, nosepiece 12 will sealingly engage landing profile 21 within production sleeve 22 (FIG. 4B). Additionally, certain exemplary embodiments of nosepiece 12 may comprise a latch; in such embodiments, landing profile 21 within production sleeve 22 will be configured with a matching latch down profile. Generally, the latch may comprise any self-energized device designed so as to engage and latch with a matching latch down landing profile 21 in production sleeve 22. In certain exemplary embodiments, the latch may comprise a self-energized "C" ring profile that can be attached to dart 10 of the present invention by expanding the "C" ring profile over the major outer diameter of nosepiece 12 so as to lodge in a groove on such outer diameter. In certain exemplary embodiments, the latch may comprise a self-energized collet type latch ring; in such embodiments, nosepiece 12 will generally comprise a threaded element to facilitate installation of the collet type latch ring. One of ordinary skill in the art with the benefit of this disclosure will be able to recognize an appropriate latch device for a particular application. Nosepiece 12 may, in certain exemplary embodiments, be coated with an elastomeric compound or fitted with one or more seal rings to enhance sealing within landing profile 21. In certain exemplary embodiments of the present invention, the seal rings comprise elastomeric "O" rings; in certain of these exemplary embodiments, the seal rings may be made from a material such as a fluoro-elastomer, nitrile rubber, VITON™, AFLAS™, TEFLON™, or the like. In certain exemplary embodiments of the present invention, the seal rings comprise chevron-type "V" rings. One of ordinary skill in the art, with the benefit of this disclosure, will be able to recognize applications where the use of seal rings may be appropriate, and will further recognize the appropriate type and material for a particular application. Alternatively, nosepiece 12 may be fitted with one or more uniquely shaped keys that will selectively engage with a matching uniquely shaped landing profile 21 in the particular sleeve 22. In certain exemplary embodiments wherein multiple sleeves 22 are present in the subterranean formation, the use of uniquely shaped keys and matching uniquely shaped landing profiles 21 will permit the configurations of all sleeves 22 to have a common minimum inner diameter.

Figure 2:
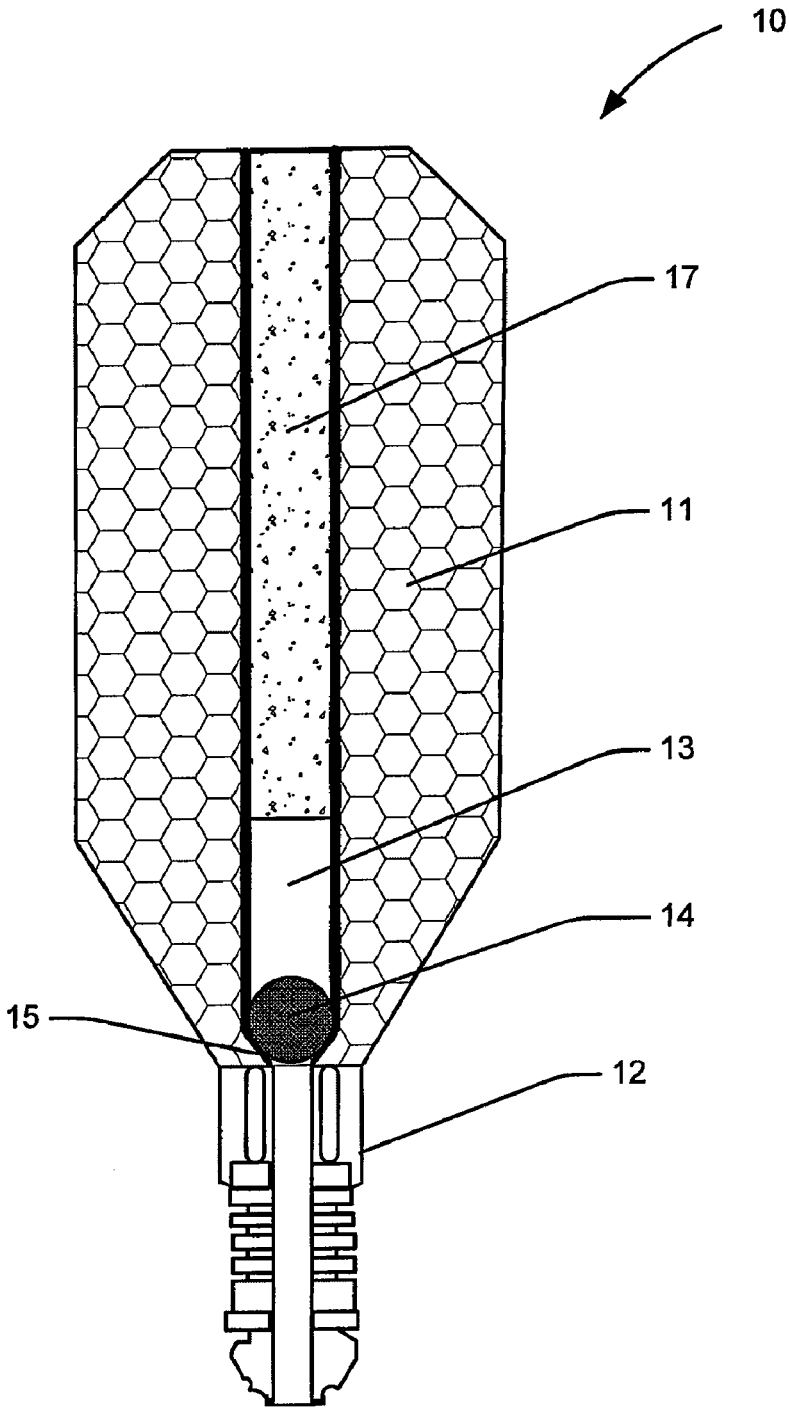
FIG. 2 is a side cross-sectional view of an exemplary embodiment of a dart of the present invention.

In certain embodiments, a porous material 17 may be used as a component of dart 10, as depicted in FIG. 2. If used, porous material 17 is preferably within a portion of channel 13 within body 11, and the presence of ball retainer 16 is optional. Porous material 17 may be any material comprising pores and allowing fluid to flow through. Suitable examples of porous material 17 include, but are not limited to composites, plastics, ceramics, particulates, and other materials. Among other benefits, porous material 17 may serve to absorb the deformations in body 11 that may result as dart 10 passes through restrictive areas, e.g., a work string, which may reduce the risk of separation of body 11 from nosepiece 12, or reduce the risk of structural impairment caused by compressive force.

Figure 3:
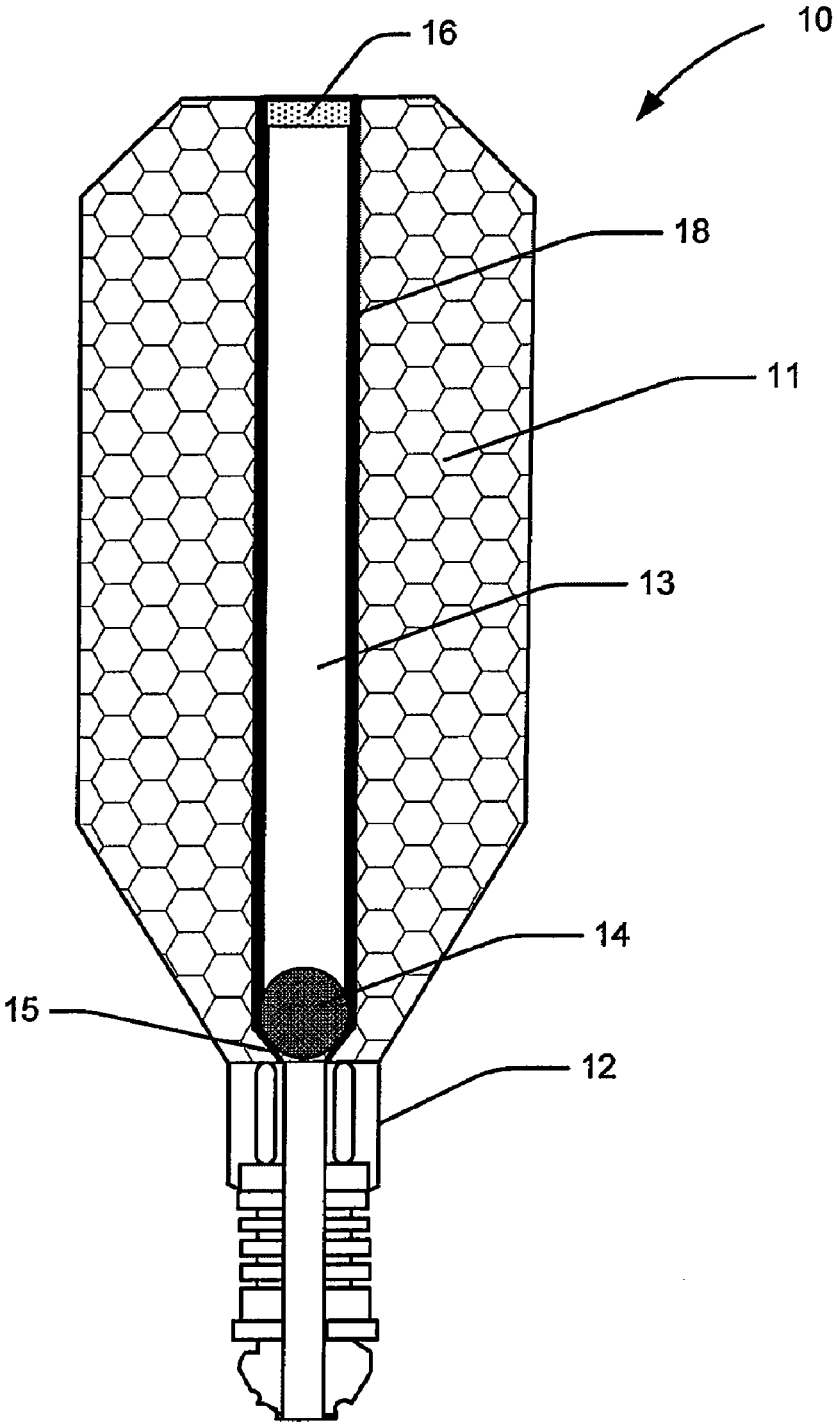
FIG. 3 is a side cross-sectional view of an exemplary embodiment of a dart of the present invention.

As illustrated in FIG. 3, in certain embodiments, the portion of channel 13 within body 11 may be lined with a stiffener 18 such that the structural integrity of the channel is maintained upon the application of compressive force. Stiffener 18 may be constructed of any material suitable for use in the subterranean environment into which dart 10 will be put, in which the material also has sufficient elastic and/or strengthening properties. Additionally, stiffener 18 desirably has holes, slots, pores, or other openings for allowing flow therethrough. Suitable examples of material for stiffener 18 include, but are not limited to composites, plastics, ceramics, particulates, and other materials.

Ball 14 may be made of any material suitable for use in the subterranean environment in which dart 10 will be placed. Suitable examples of materials are composites, plastics, ceramics, particulates, and other materials. Ball 14 primarily functions to allow a positive seal from fluid above and allows flow through from below. Ball 14 may allow positive displacement during stimulation of a well, while still giving the operator the option to immediately flow back from the formation after stimulation. When ball retainer 16 is included in dart 10 of the present disclosure, ball retainer 16 may be made any material suitable for use in the subterranean environment in which dart 10 will be placed. Suitable examples of materials are composites, plastics, ceramics, particulates, and other materials. Ball retainer 16 should also include openings through which fluid may pass.

In some embodiments, ball 14 and ball seat 15 may be replaced by any other pressure sealing member, such as a flapper valve, a spring loaded check valve, or a collapsible orifice. The pressure sealing member may be sealed by the introduction of treatment fluid into the subterranean formation. The pressure sealing member may be thereafter unsealed such that production fluid can subsequently pass therethrough.

Figure 4C:
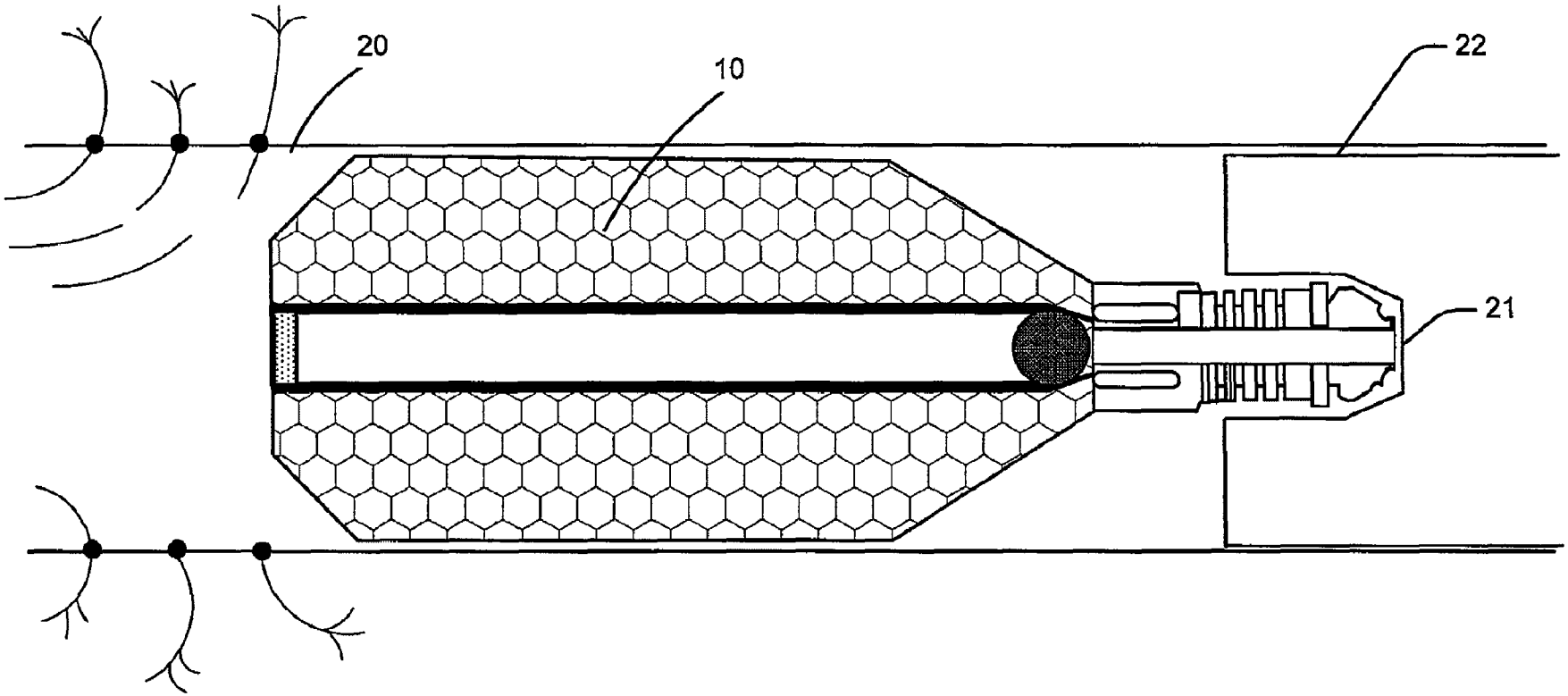

Dart(s) 10 may be introduced into production sleeve 22 in a variety of ways. For example, dart 10 may be introduced into production casing 20 at the surface and then pumped down through production casing 20 until dart 10 contacts landing profile 21 of production sleeve 22. Alternatively, a differential pressure may be applied to dart 10 causing it to travel through production casing 20 until it contacts landing profile 21 of production sleeve 22, as shown in FIG. 4B. Once nosepiece 12 has contacted landing profile 21 of production sleeve 22, a differential pressure may be applied across the sealing diameter of nosepiece 12 and landing profile 21 so as to activate production sleeve 22. As referred to herein, the term "activate" will be understood to mean causing production sleeve 22 to be opened so as to carry out an intended function within the well bore. For example, production sleeve 22 may be activated by allowing a dart to open the production sleeve by applying pressure until the production sleeve shifts into an open position, and then allowing a treatment fluid (such as a fracturing fluid or acidizing fluid) to flow through the ports of the opened production sleeve 22, as shown in FIG. 4C. Furthermore, after the treatment fluid has been introduced into the subterranean formation, the ball 14 may move upward such that production fluid can pass through the seat 15.

One embodiment of a method of the present invention is a method of treating a subterranean formation comprising: providing a dart comprising a deformable body, a nosepiece connected to a lower terminus of the deformable body, and a channel extending through the deformable body and the nosepiece, wherein the channel has a pressure sealing member therein; providing a production casing having at least one production sleeve therein; placing the dart in the production casing of a well bore; pumping a treatment fluid into the well bore; and allowing the dart to open the production sleeve within the production casing such that the treatment fluid is introduced into the subterranean formation through the production casing.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. For example, the use of the terms "upper" and "lower" and/or "above" and "below" do not necessarily refer to vertical directions, but may instead to refer to various horizontal directions, as would be understood by one of ordinary skill in the art. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A dart comprising:

a deformable body;

a nosepiece connected to a lower terminus of the deformable body; and a channel extending through the deformable body and the nosepiece;

wherein the deformable body is compressible to an extent at least equivalent to an outer dimension of the nosepiece;

wherein the channel has a pressure sealing member therein;

wherein the pressure sealing member seals in response to downward pressure; and wherein the pressure sealing member is a seat and a ball, the dart further comprising a ball retainer above the seat of the channel.

2. The dart of claim 1, further comprising a porous material within the channel.

3. The dart of claim 1, further comprising a stiffener.

4. The dart of claim 1, wherein the deformable body comprises an elastomer.

5. The dart of claim 1, wherein the nosepiece is configured to engage a landing profile of a production sleeve.

6. The dart of claim 1, wherein the deformable body comprises a foam.

7. A dart comprising:

a deformable body;

a nosepiece connected to a lower terminus of the deformable body; and a channel extending through the deformable body and the nosepiece;

wherein the deformable body is compressible to an extent at least equivalent to an outer dimension of the nosepiece;

wherein the channel has a pressure sealing member therein;

wherein the pressure sealing member seals in response to downward pressure; and wherein the pressure sealing member is selected from the group consisting of: a flapper valve; a spring loaded check valve; and a collapsible orifice.

8. A method of treating a subterranean formation comprising:

providing a dart comprising a deformable body, a nosepiece connected to a lower terminus of the deformable body, and a channel extending through the deformable body and the nosepiece, wherein the channel has a pressure sealing member therein;

providing a production casing having at least one production sleeve therein;

placing the dart in the production casing of a well bore;

pumping a treatment fluid into the well bore; and allowing the dart to open the production sleeve within the production casing such that the treatment fluid is introduced into the subterranean formation through the production casing.

9. The method of claim 8, wherein the pressure sealing member is sealed by the introduction of treatment fluid into the subterranean formation.

10. The method of claim 9, further comprising allowing the pressure sealing member to unseal such that production fluid can pass therethrough after the treatment fluid has been introduced into the subterranean formation.

11. The method of claim 8, wherein the pressure sealing member is selected from the group consisting of: a seat and a ball; a flapper valve; a spring loaded check valve; and a collapsible orifice.

12. The method of claim 8, wherein the dart further comprises a porous material within the channel.

13. The method of claim 8, wherein the dart further comprises a stiffener.

14. The method of claim 8, wherein the deformable body comprises an elastomer.

15. The method of claim 8, wherein the nosepiece is configured to engage a landing profile of the production sleeve.

16. The method of claim 8, wherein the deformable body comprises a foam.

17. The method of claim 8, wherein the treatment fluid comprises a fracturing fluid.

18. The method of claim 8, wherein the treatment fluid comprises an acidizing fluid.

19. The method of claim 8, wherein allowing the dart to open the production sleeve comprises applying pressure until the production sleeve shifts into an open position.

* * * * *